US007898432B2

(12) United States Patent
McNew et al.

(10) Patent No.: US 7,898,432 B2
(45) **Date of Patent: *Mar. 1, 2011**

(54) SYSTEM AND METHOD FOR DETERMINING INTERSECTION RIGHT-OF-WAY FOR VEHICLES

(75) Inventors: Justin Paul McNew, Del Mar, CA (US); John Thomas Moring, Encinitas, CA (US); Khaled I. Dessouky, Studio City, CA (US)

(73) Assignee: Kapsch Trafficcom AG, Vienna (AT)

( * ) Notice: Subject to any disclaimer, the term of this patent is extended or adjusted under 35 U.S.C. 154(b) by 0 days.

This patent is subject to a terminal disclaimer.

(21) Appl. No.: 12/619,632

(22) Filed: Nov. 16, 2009

(65) Prior Publication Data

US 2010/0060483 A1 Mar. 11, 2010

Related U.S. Application Data

(63) Continuation of application No. 11/927,151, filed on Oct. 29, 2007, now Pat. No. 7,639,159.

(51) Int. Cl.
*G08G 1/07* (2006.01)

(52) U.S. Cl. ..... 340/916; 340/905; 340/907; 340/935; 340/939; 340/931; 701/53; 701/59; 701/117

(58) Field of Classification Search ..... 340/916, 340/905, 907, 935, 939; 701/53, 59, 117
See application file for complete search history.

(56) References Cited

U.S. PATENT DOCUMENTS 4,357,593 A * 11/1982 von Tomkewitsch ..... 340/988
4,463,339 A * 7/1984 Frick et al. ..... 340/906
5,283,573 A 2/1994 Takatou et al.
5,537,323 A 7/1996 Schulte
5,745,865 A * 4/1998 Rostoker et al. ..... 455/456.5
5,777,564 A * 7/1998 Jones ..... 340/917
5,926,114 A * 7/1999 Andrews ..... 340/909
5,929,787 A * 7/1999 Mee et al. ..... 340/907
5,940,010 A * 8/1999 Sasaki et al. ..... 340/901
6,008,741 A * 12/1999 Shinagawa et al. ..... 340/907
6,223,125 B1 * 4/2001 Hall ..... 701/301
6,236,933 B1 * 5/2001 Lang ..... 701/117

(Continued)

OTHER PUBLICATIONS

International Search Report and Written Opinion dated Dec. 29, 2008 for the corresponding PCT Application No. PCT/US2008/081465; 7pp.

*Primary Examiner*—Daniel Wu
*Assistant Examiner*—Son M Tang
(74) *Attorney, Agent, or Firm*—Christie, Parker & Hale, LLP

(57) ABSTRACT

A method and system for determining right of way for a plurality of mobile units at an intersection. The method and system include collecting position and movement information about the plurality of mobile units approaching the intersection; storing a plurality of rules about right of way at the intersection; accessing information about geometry of the intersection; calculating which one or more of the plurality of the mobile units have right of way to enter the intersection, responsive to the position and movement information, the stored rules and the information about geometry of the intersection; and wirelessly transmitting right of way indication signals to one or more of the plurality of the mobile units.

18 Claims, 2 Drawing Sheets

U.S. PATENT DOCUMENTS 6,292,109 B1 * 9/2001 Murano et al. ..... 340/903
6,307,484 B1 * 10/2001 Sasaki et al. ..... 340/903
6,333,701 B1 * 12/2001 Mee et al. ..... 340/907
6,396,417 B2 * 5/2002 Lee ..... 340/904
6,405,132 B1 6/2002 Breed et al.
6,516,273 B1 * 2/2003 Pierowicz et al. ..... 701/301
6,617,981 B2 * 9/2003 Basinger ..... 340/909
6,624,782 B2 * 9/2003 Jocoy et al. ..... 342/70
6,707,391 B1 * 3/2004 Monroe ..... 340/901
7,140,803 B2 * 11/2006 Cummings et al. ..... 404/12
7,167,106 B2 * 1/2007 Haase ..... 340/909
7,167,799 B1 * 1/2007 Dolgov et al. ..... 701/301
7,342,509 B2 * 3/2008 Tauchi ..... 340/905
7,573,400 B2 * 8/2009 Arnold et al. ..... 340/907
7,663,505 B2 * 2/2010 Publicover ..... 340/932
7,689,347 B2 * 3/2010 Wall, III ..... 701/117
7,734,275 B2 * 6/2010 Kubota et al. ..... 455/344
2005/0104745 A1 5/2005 Bachelder et al.
2006/0109095 A1 * 5/2006 Takata et al. ..... 340/436
2007/0071549 A1 * 3/2007 Cummings et al. ..... 404/12

* cited by examiner

SYSTEM AND METHOD FOR DETERMINING INTERSECTION RIGHT-OF-WAY FOR VEHICLES

CROSS-REFERENCE TO RELATED APPLICATIONS

This patent application is a continuation of U.S. patent application Ser. No. 11/927,151, filed Oct. 29, 2007 now U.S. Pat. No. 7,639,159 and is related to U.S. patent application Ser. No. 11/852,054, filed on Sep. 7, 2007 and entitled "SYSTEM AND METHOD FOR SHORT RANGE COMMUNICATION USING ADAPTIVE CHANNEL INTERVALS"; and U.S. patent application Ser. No. 11/859,978, filed on Sep. 24, 2007 and entitled "METHOD AND SYSTEM FOR BROADCAST MESSAGE RATE ADAPTATION IN MOBILE SYSTEMS."

FIELD OF THE INVENTION

The present invention relates generally to intelligent vehicle systems and more specifically to determining which vehicle(s) have right of way at an intersection and communicating that information to the vehicles.

BACKGROUND OF THE INVENTION

There is increasing efforts for integrating communication and computing technologies into motor vehicles to improve the safety and efficiency of roadways. For example, the US government has an ongoing Intelligent Transportation Systems initiative (US Department of Transportation, Intelligent Transportation Systems).

The ability to determine the location of moving vehicles via a Global Positioning System (GPS) or other location determination means for the purpose of collision avoidance is known, for example, see, U.S. Pat. No. 6,405,132, which describes an accident avoidance system. Additionally, U.S. Pat. No. 6,281,808 describes an intelligent control of traffic signals.

However, these systems and methods do not address an automated determination and dissemination of right of way information when multiple vehicles approach an (uncontrolled) intersection.

SUMMARY

In some embodiment, the present invention is a method and system for determining right of way for a plurality of mobile units at an intersection. The method and system include collecting position and movement information about the plurality of mobile units approaching the intersection; storing a plurality of rules about right of way at the intersection; accessing information about geometric and/or map representation of the intersection; calculating which one or more of the plurality of the mobile units have right of way to enter the intersection, responsive to the position and movement information, the stored rules and the geometric and/or map representation information; and wirelessly transmitting right of way indication signals to one or more of the plurality of the mobile units.

DETAILED DESCRIPTION

In some embodiment, the present invention includes a stationary communications and processing unit located near a traffic intersection, the intersection being either uncontrolled or having a traffic signal that is not operational. The stationary unit has access to a map and/or geometric representation (for example, in a geographical information system (GIS) format) of the intersection, and to right of way and safety rules related to the intersection. The stationary unit collects real-time position and movement information about one or more vehicles approaching the intersection as well as the status of the traffic signal, if one exists. Using this information, and taking into account safety rules and the map response information, the stationary unit determines which vehicle(s) have right of way at the intersection and then communicates that information to the vehicles.

Figure 1:
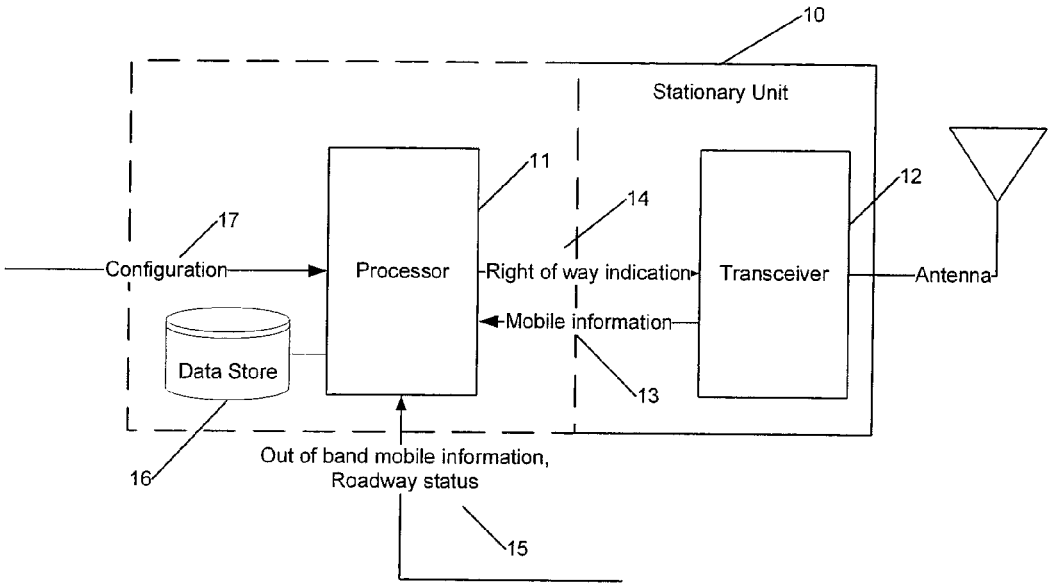
FIG. 1 shows an exemplary configuration of a stationary (roadside) unit, according to some embodiments of the present invention.

FIG. 1 shows an exemplary configuration of a roadside unit, according to some embodiments of the present invention. A stationary unit, for example, roadside unit 10 may be positioned near an intersection and may include wireless communications means, such as a transceiver 12, allowing connectivity with the vehicles approaching an intersection. A processing unit 11 calculates and generates right of way indications information 14. Although shown local to the roadside unit, the processing unit may be remote to the roadside unit. The roadside unit 10 also includes knowledge of the intersection and surrounding geometry, for example, via stored detailed map information 16 stored in a database (storage medium). This information knowledge of intersection may be stored remotely and communicated to the roadside unit on demand basis.

Figure 2:
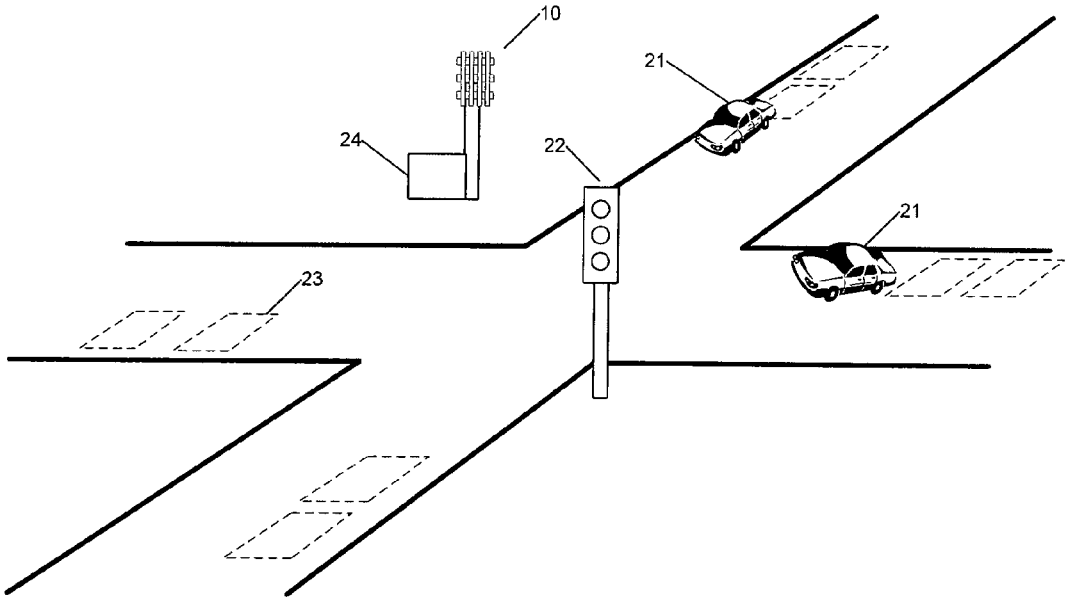
FIG. 2 illustrates a system for determining right of way at a traffic intersection, according to some embodiments of the present invention.

FIG. 2 illustrates a system (environment) for determining right of way at a traffic intersection, according to some embodiments of the present invention. Vehicles 21 include wireless communications capability, allowing connectivity with one or more roadside units. Vehicles 21 may also include operator interface, with the ability to indicate right of way (or lack thereof), for example in a way of display, voice activated indication, and/or sensors, servos and actuators for automatically controlling the movements of the vehicles, for example, in the case of un-manned vehicles. Vehicles 21 may also include position determination capability, where accurate and timely mobile information 13 is determined and communicated to the roadside unit, allowing the roadside unit to track and predict vehicle trajectories. The positioning capability used to determine the positions of the vehicles 21, may be onboard the vehicles, for example, satellite based, like GPS, differential GPS, a combination of GPS and future satellite systems, or may be using embedded sensors 23 in the roadside unit, and/or around the intersection, or may use combinations of such positioning methods to yield accurate, lane and sub-lane level positioning. Existing navigation units in the vehicle may be used for some of these functions.

Additionally, the system may include an out of band (e.g., wireline) communications means 24, that allows the roadside unit 10 to receive such information as operational status from a local traffic signal 22, traffic status from the local sensors 23, database and configuration updates 17 from a remote source, and the knowledge of the intersection if such information is stored remote to the roadside unit.

Using the knowledge of the intersection and surrounding locale, the processor unit 11 evaluates vehicle (mobile unit) movement in the context of the intersection and local environment. Vehicle movement information includes at least vehicle location. From a series of location updates, vehicle direction, speed, and acceleration may be either calculated onboard the vehicle and reported to the roadside unit, or calculated in the processor associated with the roadside unit. Additional information that pertains to vehicle movement may be included. This additional information may include real-time information such as vehicle braking or turning status. The additional information may also include vehicle parameters that affect the vehicle's movement or priority, such as weight and size, or vehicle status (for example, emergency vehicle). Local information may include the route of roads entering the intersection, prevailing speed limits on those routes, location of turn-only lanes, size and orientation of the intersection itself, etc. In some embodiments, the local information (or a portion thereof) is received from a central source. The local information may be entered in the roadside unit directly or via messages received over a network connection. The evaluation in the processor includes such calculations as a prediction on when the vehicle will reach the intersection, the path it will take, and when it will exit the intersection.

Real time information may include the location/heading/speed of approaching traffic, vehicle acceleration, and vehicle capabilities, such as the ability to accept and process right of way messages. This vehicular information may be received via reports or messages from the vehicles themselves, as well as from sensors (for example, cameras, radar, magnetic strips embedded in the roadway, etc.) positioned in proximity of the intersection. Real time information may also include prevailing conditions that affect traffic, such as weather, road condition and visibility, lane closures, constructions, etc.). This information may be received by the stationary unit from a central source, and/or from a local source (e.g., a road work crew, and/or various local sensors). In some embodiments, the prevailing conditions that affect traffic and the road are given different importance weights. For example, if a road is closed, no matter what, no vehicle would be allowed to go through, if the road is wet, the importance of the speed of the vehicles is increased, or if the visibility is weak, the importance of distance to the intersection is increased.

The wireless communication means (for example, 12 in FIG. 1) may be any communications that allows low-latency information transfer between vehicles and the stationary unit. One technology particularly suited to this purpose is alternately known as wireless access in vehicular environments (WAVE) or dedicated short range communications (DSRC). Vehicles could automatically generate periodic updates of their positions and status and/or the roadside unit can poll the vehicles for this information.

Traffic rules are construed and programmed based on the prevailing laws in effect at the locale, applied to the specific topology of the intersection. Some simplified examples of such rules are shown here in the form of right of way priority lists for two exemplary scenarios. A vehicle whose trajectory will not cause a collision or near-collision with any other vehicle is granted right of way. Otherwise, the vehicle(s) meeting the criterion highest on the list is granted right of way over all other approaching vehicles.

1—Minor road crossing a major road:
- i) Emergency vehicle
- ii) Through traffic on major road.
- iii) Right turning vehicle from major road.
- iv) Left turning vehicle from major road.
- v) Through traffic on minor road.
- vi) Right turning vehicle from minor road.
- vii) Left turning vehicle from minor road.

2—Crossing of two minor roads:
- i) Emergency vehicle
- ii) First vehicle to the intersection.
- iii) In the case of simultaneous arrivals:
  - (1) If vehicles arrive at adjacent intersection entrances, the rightmost vehicle.
  - (2) If vehicle arrive from opposite intersection entrances, the through or right-turning vehicle(s).

The vehicles that receive the right of way messages from the stationary unit may act on the information in different ways depending on system design and vehicle capabilities. An on-board light or display (e.g., red/yellow/green) may be used to indicate right of way to the driver. Alternately, or in conjunction, different audible tones could express that information. Language-based information could also be provided, audibly, and/or visually. If the vehicle is equipped with an automatic control feature, the right of way information could be used by the vehicle controller to invoke braking, steering, and/or accelerating/decelerating controls to prevent the vehicle from entering the intersection or parts thereof if right of way has not been granted.

Figure 3:
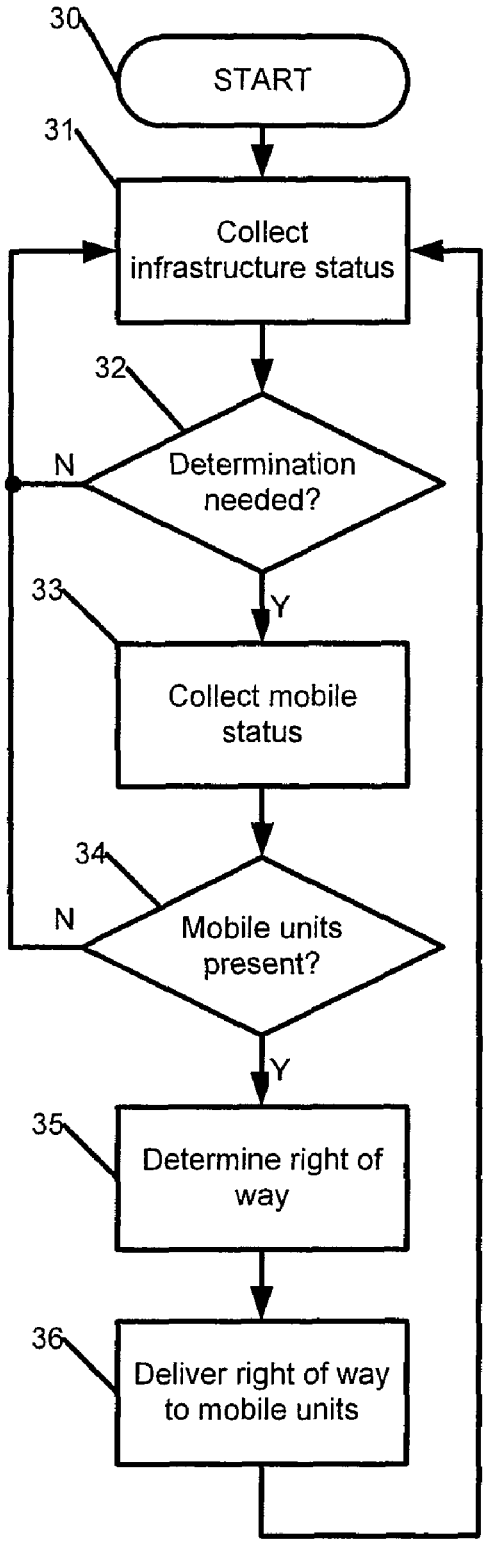
FIG. 3 illustrates an exemplary processing flow associated with determining the right of way, according to some embodiments of the present invention.

FIG. 3 illustrates an exemplary process flow associated with determining the right of way, according to some embodiments of the present invention. In block 31, the process collects infrastructure status information, such as whether the local traffic signal is functional. From this information, in block 32, the process determines whether a right of way determination process is needed at the current time, for example, if the signal is not functional. If a determination process is needed, the process collects mobile unit status, in block 33, for example from wireless signals and/or roadside sensors. If no mobile units (vehicles) are detected (block 34), the process continues monitoring for the presence of any newly-arrived vehicles. If mobile units are detected, the process invokes the right of way rules to determine which mobile unit or units has right of way, in block 35. The process then reports the result to all present mobile units, in block 36. Upon receiving the right of way determination results, the vehicles act according to the results, as explained above.

An exemplary scenario follows. Assume that multiple intelligent vehicles approach an intersection and the traffic signal at the intersection is temporarily disabled due to a failure. The vehicles at intervals automatically report their positions, directions, and speeds to a stationary unit located at or near the intersection. Using its knowledge of the intersection geometry, programmed traffic rules, vehicles' trajectories, and local information (such as weather or road condition) the roadside unit sends right of way messages or commands to each of the vehicles, which are in turn conveyed to the drivers or to the control systems of each vehicle. For example, north-south bound vehicles are sent a STOP message, conveyed to drivers by a red dashboard light and/or an audible command. East-west bound vehicles are sent a PROCEED WITH CAUTION message, displayed perhaps as a green/yellow light and/or audible indication. Once the initial east-west bound vehicles clear the intersection, subsequent east-west bound vehicles receive STOP messages, and north-south bound vehicles receive PROCEED WITH CAUTION messages.

Different countries or legal jurisdictions may have different rules for right of way. Different rules may include granting priority to the first vehicle to arrive, the vehicle on the more major roadway, or the vehicle arriving from the other vehicle's right. Thus the right of way determination algorithm is programmed to reflect local laws.

In some embodiments, the roadside unit recognizes (e.g., via the above-mentioned sensors) an approaching vehicle that does not have the ability to process the right of way messages, that is, a non-intelligent vehicle. In this case, the roadside unit's right of way determination may hold back the intelligent vehicles to allow the non-intelligent vehicle to pass safely. In some embodiments, the roadside unit recognizes emergency vehicles and grants them right of way over non-emergency vehicles.

In some embodiments, the roadside unit considers turning intentions of a vehicle determined through any of a number of means, such as location of the vehicle in a turn lane, direction vector of the vehicle or activation of a turn signal within the vehicle. Additionally, the intelligent vehicle may have knowledge of its route or end destination and be able to provide an explicit report to the stationary unit, indicating its immediate intentions at the intersection (e.g., proceed straight, turn left, etc.), as it approaches the intersection.

In some embodiments, the roadside unit monitors the status of the traffic signal controlling access to the intersection, and performs right of way determination when detecting a disruption of the signal's functionality, an emergency, or any other appropriate condition. In some embodiments, the roadside unit performs right of way determination in the presence of a functional signal, to provide guidance in situations where right of way is not unambiguously indicated by the signal. Such a case is where a left-turning vehicle has a green light, but must yield to oncoming traffic.

In some embodiments, to prevent the possibility of directing a vehicle into a dangerous situation, the system provides negative messages to vehicles not found to have right of way in addition to providing positive messages granting right of way.

Note that for simplicity reasons, the disclosure assumes a typical intersection with two crossing perpendicular roadways. However, the present invention can be applied equally to other situations where intersecting traffic patterns cause a potential for collisions. Examples of alternate types of intersections include, but are not limited to, merges, traffic circles, driveways entering a roadway, and intersections with less or more than four entrances.

It can also be seen, that though this invention has been described in the context of a public roadway, alternate embodiments also represent the invention. For example, the invention can be applied to maritime navigation systems, airport ground traffic, and industrial machinery. In these applications different rules stored in the system would govern the right of way determination and different factors, for example the weather in the airport case and the wind or water conditions in the maritime navigation case may be given different weights.

In summary, while certain exemplary embodiments have been described above in detail and shown in the accompanying drawings, it is to be understood that such embodiments are merely illustrative of and not restrictive of the broad invention. In particular, it should be recognized that the teachings of the invention apply to a wide variety of systems and processes. It will thus be recognized that various modifications may be made to the illustrated and other embodiments of the invention described above, without departing from the broad inventive scope thereof. In view of the above it will be understood that the invention is not limited to the particular embodiments or arrangements disclosed, but is rather intended to cover any changes, adaptations or modifications which are within the scope and spirit of the invention as described herein.

What is claimed is:

1. A method for determining right of way for a mobile unit at an intersection, the method comprising:

collecting movement information about a plurality of mobile units approaching the intersection;

obtaining information about geometry of the intersection;

determining whether the mobile unit has right of way to enter the intersection, responsive to the movement information, the information about geometry of the intersection and a plurality of rules;

detecting whether a traffic signal at the intersection is functional; and transmitting a right of way indication signal to the mobile unit when the traffic signal is detected to be not functioning.

2. The method of claim 1, wherein the movement information is collected over a radio communications link.

3. The method of claim 1, wherein at least a portion of the movement information is collected from one or more stationary sensors.

4. The method of claim 1, wherein at least a portion of the movement information is derived from a Global Positioning System.

5. The method of claim 1, wherein the collected movement information further includes one or more of position, direction, braking status, acceleration status, and turn status.

6. A system for determining right of way for a mobile unit at an intersection comprising:

a stationary unit for collecting movement information about a plurality of mobile units approaching the intersection;

a processing unit for calculating whether the mobile unit has right of way to enter the intersection, based on the movement information and a plurality of rules;

a storage medium for storing information about road and weather condition, wherein the processing unit calculates whether the mobile unit has the right of way utilizing the information about road and weather condition; and a communication unit for transmitting a right of way indication signal to the mobile unit.

7. The system of claim 6, further comprising a display unit in the mobile unit for providing a visual indication or an audible indication of the received right of way indication signal.

8. The system of claim 6, further comprising vehicular controls for preventing a mobile unit from entering the intersection.

9. The system of claim 6, further comprising a plurality of stationary sensors for generating at least a portion of the position and movement information.

10. The system of claim 6, wherein the processing unit is remote from the stationary unit.

11. The system of claim 6, wherein the processing unit is local to the stationary unit.

12. The system of claim 6, wherein the information about geometry of the intersection includes a map representation of the intersection.

13. The system of claim 6, further comprising one or more storage media for storing information about geometry of the intersection and the plurality of rules.

14. A method for determining right of way for a plurality of mobile units at an intersection, the method comprising:

collecting infrastructure status information about the intersection;

determining whether a right of way determination is needed for the intersection at a current time according to the collected infrastructure status information;

determining whether there are any mobile units approaching or at the intersection, when it is determined that a right of way determination is needed for the intersection;

collecting movement information about one or more of the plurality of the mobile units approaching or at the intersection; and determining which one or more of the plurality of the mobile units have right of way to enter the intersection, responsive to the movement information, information about geometry of the intersection and a set of rules.

15. The method of claim 14, further comprising transmitting right of way indication signals to one or more of the plurality of the mobile units.

16. The method of claim 14, further comprising receiving route or end destination for one or more of the plurality of the mobile units from respective one or more of the plurality of the mobile units; and utilizing the received route or end destination to determine which one or more of the plurality of the mobile units have right of way to enter the intersection.

17. The method of claim 14, wherein the collected movement information further includes one or more of position, direction, braking status, acceleration status, and turn status.

18. The method of claim 14, further comprising obtaining information about road and weather condition; and utilizing the obtained information to determine which one or more of the plurality of the mobile units have right of way to enter the intersection.

* * * * *